US006394624B1

(12) United States Patent
Hsu

(10) Patent No.: US 6,394,624 B1
(45) Date of Patent: May 28, 2002

(54) DECORATIVE ARTIFICIAL ICICLE

(76) Inventor: Yu-Yuan Hsu, 1F, No. 27-2, Lane 315, Sec. 1, Shih-Pai Rd., Pei-Tou Dist., Taipei (TW)

( * ) Notice: Subject to any disclaimer, the term of this patent is extended or adjusted under 35 U.S.C. 154(b) by 0 days.

(21) Appl. No.: 09/817,709

(22) Filed: Mar. 26, 2001

(51) Int. Cl.[7] ..... F21V 21/00
(52) U.S. Cl. ..... 362/249; 362/252; 362/806
(58) Field of Search ..... 362/123, 226, 362/236, 237, 240, 249, 252, 246, 396, 806, 808, 267

(56) References Cited

U.S. PATENT DOCUMENTS 3,011,049 A * 11/1961 Kinghorn ..... 362/806
3,704,365 A * 11/1972 Miller ..... 362/806
3,755,663 A * 8/1973 George, Jr. ..... 362/252
4,679,126 A * 7/1987 Van Sickler ..... 362/226
5,918,967 A * 7/1999 Land ..... 362/806
6,224,239 B1 * 5/2001 Adler ..... 362/806

* cited by examiner

*Primary Examiner*—Y. My Quach-Lee
(74) *Attorney, Agent, or Firm*—Dellett and Walters

(57) ABSTRACT

A decorative artificial icicle for receiving a lampset therein includes a tubular tapered body, and a long plug receivable in a top of the body. The plug includes a cap and a clip with at least one clamp formed thereon. The clip extends into the tubular tapered body when the cap is secured in the top thereof. The clamp retains a bulb in a desired location.

10 Claims, 5 Drawing Sheets

DECORATIVE ARTIFICIAL ICICLE

BACKGROUND OF THE INVENTION

1. Field of the Invention

The present invention relates to a decorative icicle and more particularly a decorative artificial icicle with a strong body and which is easily assembled during manufacturing and repair.

2. Description of Related Art

Christmas is a festive time during which people all over the world decorate Christmas trees and try to create an illusion of snowy weather etc in and around their homes. As Christmas occurs in the winter of the Northern Hemisphere, those in the Southern Hemisphere, as well as in the tropics can never see icicles on trees outside their homes. Thus artificial icicles made of plastic or glass have long been a popular form of decoration for Christmas trees. Originally such icicles were simply made of glass and hung independently on the tree, but the lack of novelty soon led to boredom with such decorations and thus artificial icicles with illuminating devices housed thereinside were found on the market.

FIGS. 4 and 5 show one prior art decorative artificial icicle (80) comprising a tapered body and a plurality of light bulbs (90) connected by a supply wire (94) which extends from the body. The body is composed of two longitudinal hollow members (82) which are substantially symmetric and are joined together by series of mated integral pins (822) and sockets (824). As shown in FIG. 5, each hollow member (82) has pin (822) and socket (824) pairs formed along the length thereof and a pair of spaced apart legs (820) is formed between each pair of the pin (822) and socket (824). Each hollow member (82) further has a substantially closed top end with a half notch (826) defined centrally therein whereby when the hollow members (82) are combined an entrance is defined for access of the supply wire (94) to the interior of the body. The bulbs (90) are retained in a desired place within the body by engagement of a bulb holder (92) in a respective mated set of the legs (820). In use, electricity via the supply wire (94) lights the bulbs (90) which then radiate through the translucent body which may have an exterior formed with ribs to increase the decorative effect of the icicle which is suspended from a tree. However, the following drawbacks are experienced with the cited prior art artificial icicle:

(a) In assembly, an operator needs significant skill to line up the respective pins and sockets of the hollow members whereby the production of the icicle is slow and thus expensive. Furthermore, if, after purchase by a consumer, one of the bulbs of the icicle needs to be replaced due to malfunction, that consumer doesn't have the skill of the manufacturer's staff and thus will experience even more frustration first in trying to separate the hollow members and then trying to fit them together once the bulb has been replaced.

(b) It is necessary for the icicle to be made of plastic and the hollow members have quite thin walls, whereby the icicle body may well fracture during both manufacture and bulb replacement leading to a high rate of scrap and disappointment.

(c) As the icicles are required by consumers at Christmas, the manufacturers have to produce the icicles in the summer so that the stocks are ready at the retailers in time for the demand. However, currently the manufacturers are based in hot countries and so the fall in temperature between the summer in hot countries and the use of the icicle in winter results in changes in size of the pins and sockets whereby the difficult separation and re-assembly of the hollow members is aggravated.

(d) The seam between the hollow members sometimes becomes a gap because of variations during molding of the members, and that gap permits water and moisture to enter the icicle thereby creating potential short circuits.

SUMMARY OF THE INVENTION

The object of the present invention is to provide a decorative artificial icicle in which bulbs can be easily inserted during manufacture and easily removed for replacement.

Another object of the present invention is to provide a decorative artificial icicle without a longitudinal seam whereby moisture cannot easily enter the interior of the icicle.

Another object of the present invention is to provide a decorative artificial icicle with a body which is easily manufactured.

A decorative artificial icicle in accordance with the present invention includes a conical tube with a long plug fitted inside the tube, and a plurality of bulbs mounted to the plug. An electricity supply cable extends into the tube to connect with the bulbs.

Other objects, advantages and novel features of the invention will become more apparent from the following detailed description when taken in conjunction with the accompanying drawings.

DETAILED DESCRIPTION OF THE PREFERRED EMBODIMENT

Figure 1:
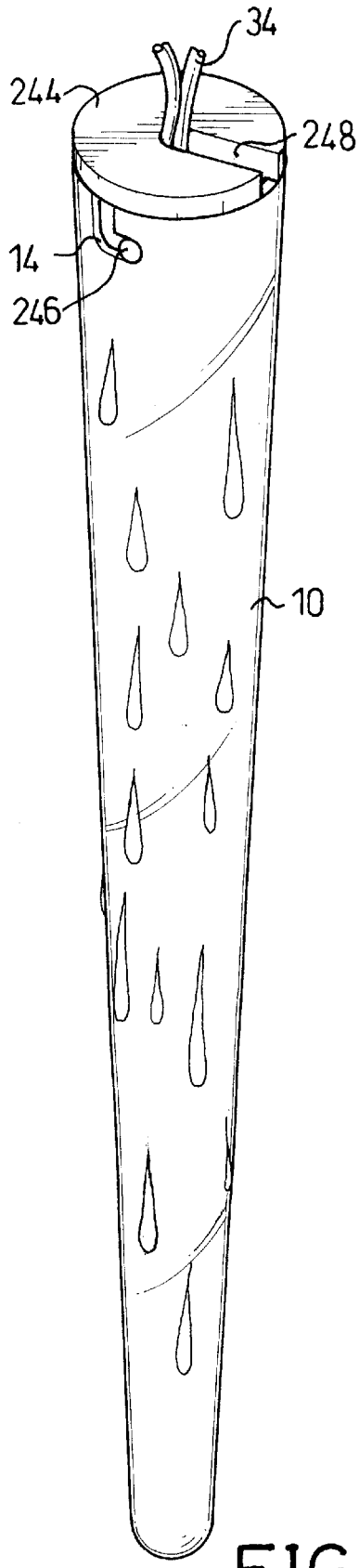
FIG. 1 is a perspective view of a decorative artificial icicle in accordance with the present invention.
Figure 2:
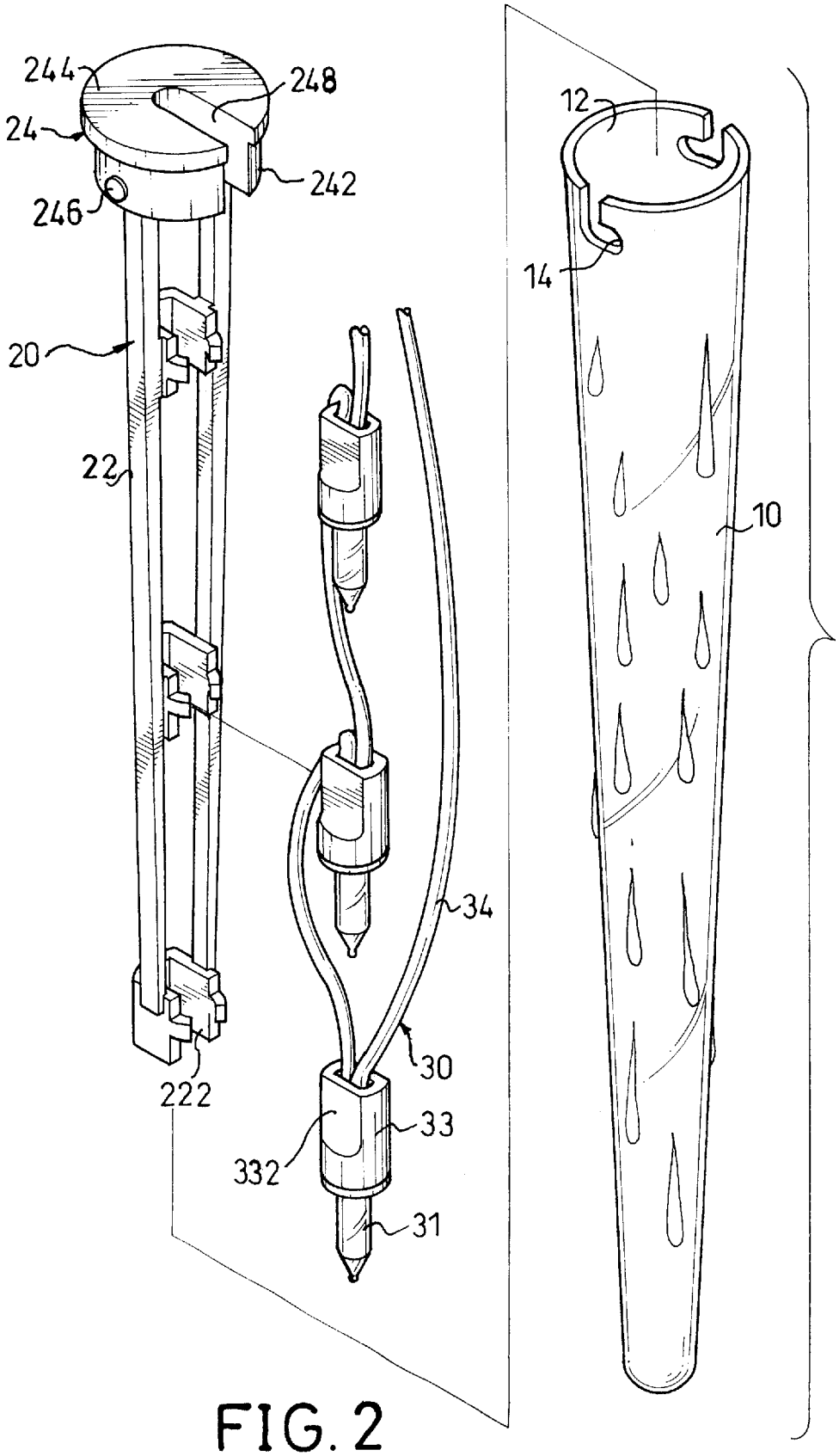
FIG. 2 is an exploded view of the decorative artificial icicle shown in FIG. 1.

Referring to the figures and particularly FIGS. 1 and 2, a decorative artificial icicle in accordance with the present invention comprises a conical tube (10), a long plug (20), and a lampset (30).

Still referring to FIGS. 1 and 2, the tube (10) comprises a cylindrical wall with a small closed bottom, a large open top, and an interior space (12). Two opposed L-shaped cutouts (14) are defined in the top of the cylindrical wall, and each cutout has an upright portion with an entrance and lateral portion with a stop. An outer periphery of the tube may be formed with protuberances to simulate a real icicle. Although in the preferred embodiment the tube tapers smaller from the open top to the closed bottom, it is to be appreciated that the invention is not restricted to that particular shape and a variety of shapes as commonly found in this field are practicable.

Referring to FIG. 2, the long plug (20) has a cap (24) formed at a top and a clip (22) extending downward from an underface of the cap (24). The clip (22) is configured to extend down the interior space (12) and includes two legs with a plurality of clamps (222) formed at intervals along and between the legs. The cap (24) has a body (242) and a flange (244) formed at a top of the body (242) and two opposed lugs (246) formed on a circumference of the body. The flange (244) has a diameter larger than a diameter of the open top of the tube. The body (242) is sized to be snugly receivable in the open top of the tube (10), and the lugs (246) are sized to be receivable in the cutouts (14). A lateral slot (248) is defined in the cap (24).

The lampset (30) includes a plurality of bulbs (31), a plurality of bulb holders (33), and an electricity supply wire (34) providing power to the bulbs (31) via the bulb holders (33). Each bulb holder (33) has a pair of opposed flats (332) sized to be securely receivable between a respective one of the clamps (222).

Figure 3:
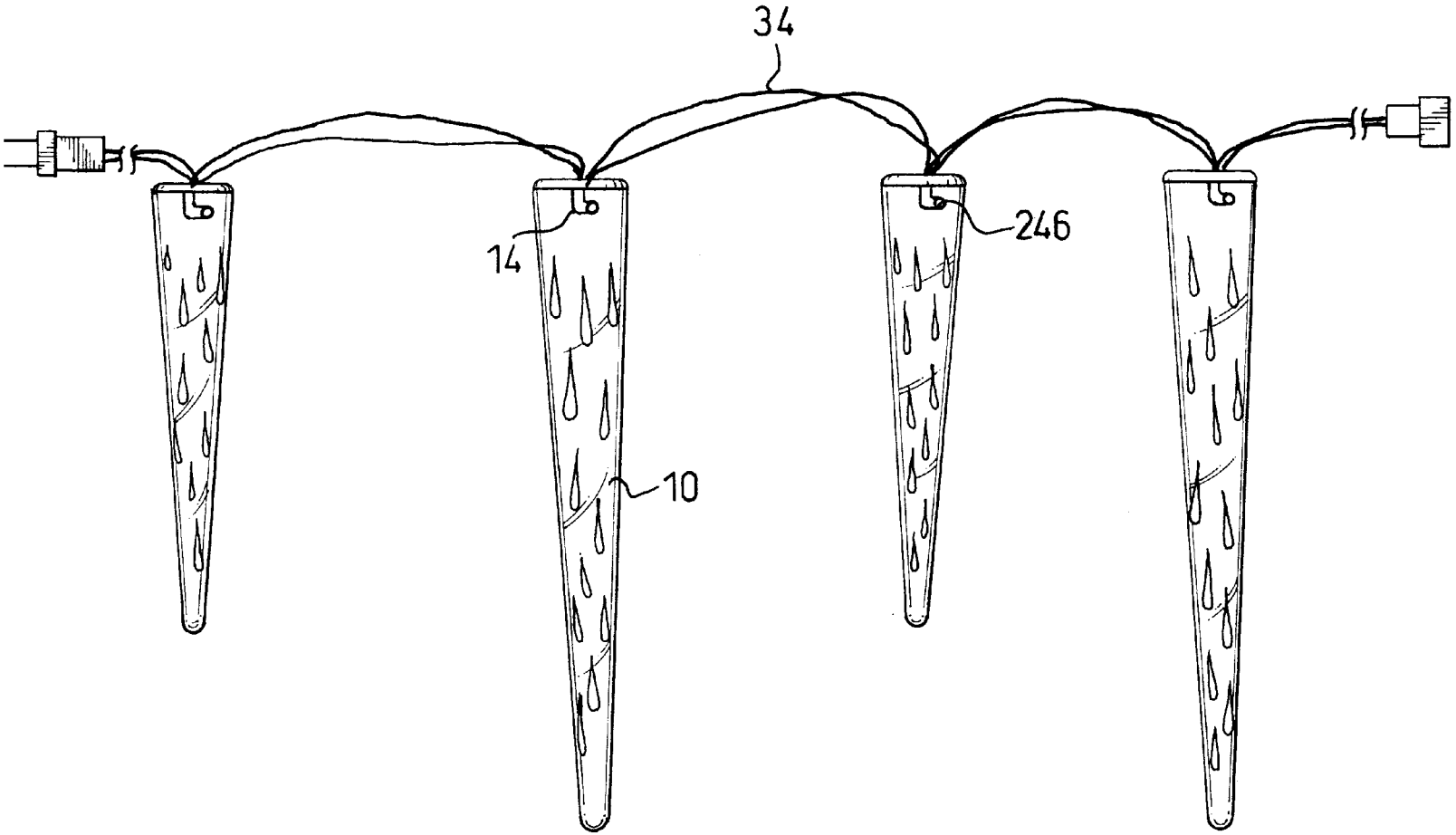
FIG. 3 is a view of a plurality of decorative artificial icicles connected to an electricity supply cable.
Figure 4:
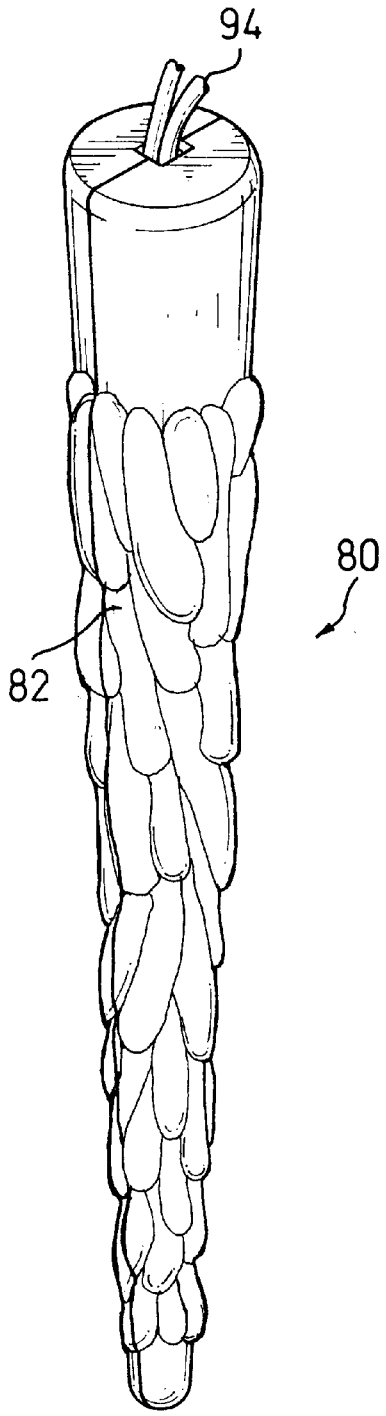
FIG.4 PRIOR ART
FIG. 4 is a perspective view of a prior art decorative artificial icicle.
Figure 5:
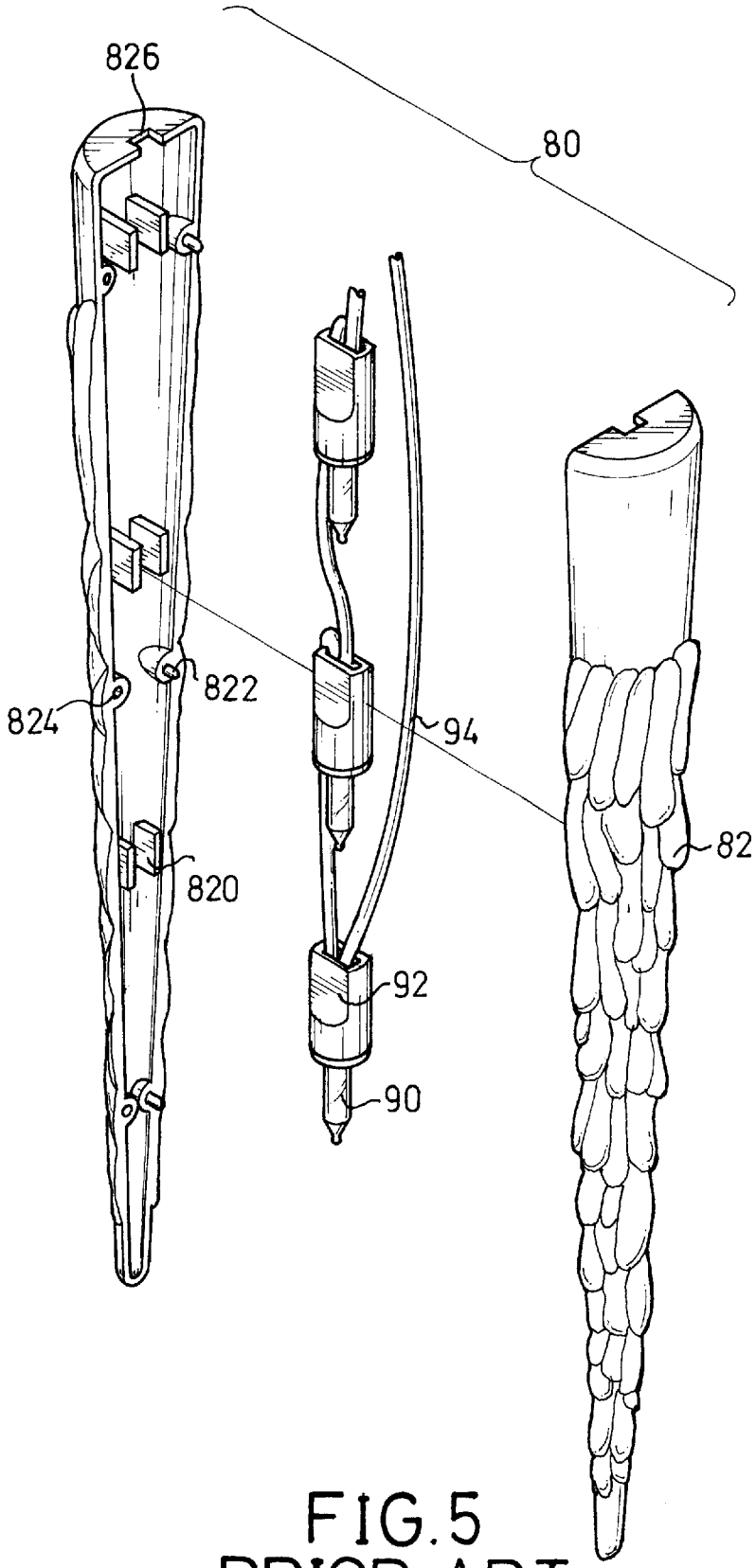
FIG.5 PRIOR ART
FIG. 5 is an exploded view of the prior art icicle shown in FIG. 4.

Referring to FIGS. 1 and 3, in assembly the bulb holders (33) combined with the bulbs (31) and the wire (34) are fitted in the plug (20) and the flats (332) are gripped by the respective clamp (222). The wire (34) extends through the slot (248) of the cap (24), and the combined lampset (30) and plug (20) are then fitted in the interior space (12) of the tube (10). The lugs (246) are respectively fitted in the upright portions of the cutouts (14) and then the plug (20) is rotated in respect to the tube (10) whereby the lugs (246) enter the lateral portions of the cutouts (14) such that the plug (20) is securely retained in the tube (10). The wire (34) extends out of the icicle via the slot (248) and connects with either an adjacent icicle or the power supply outlet. The aforementioned process is simply reversed when it is necessary to access the lampset (30). As shown in FIG. 3, the icicles may be formed in different sizes to increase the novel appearance thereof.

The decorative artificial icicle in accordance with the present invention has the following advantages:

(i) simplicity. The single piece body is easily and quickly molded.

(ii) convenience. The assembly of the body and cap is very easily achieved and does not require special skill by either assemblers in production or consumers in post-purchase operation.

(iii) low maintenance. The single piece body is not affected by climate change between production by the manufacturer and use by a consumer.

(iv) safety. The absence of any longitudinal seam prevents moisture from entering the interior space of the tube as water drips down the exterior of the body.

(v) cost saving. Only one die is required for production of the tube. Furthermore, the scrap rate of the tube is very low due to the absence of delicate or precise parts.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A decorative artificial icicle with a lampset having bulbs, bulb holders and an electric wire all received in the icicle whereby light is emitted from within the icicle, wherein the improvements comprise:

the icicle comprising:

a conical tube having an integral closed bottom, an open top, an interior space, and a retaining device formed at the open top of the tube; and a plug comprising a cap with a body adapted to be slidingly receivable in the open top of the conical tube, at least one lug formed on a periphery of the body and adapted to releasably engage with the retaining device of the conical tube, a slot defined through the body, a flange formed at a top of the body and adapted to abut the open top of the conical tube, and a support means to clamp the lampset and extended downward from the body and into the interior space of the conical tube, such that the lampset is securely supported in the interior space of the conical tube, and the lampset can be conveniently and securely assembled with the conical tube and removed from the conical tube.

2. The decorative artificial icicle as claimed in claim 1, wherein the retaining device of the conical tube comprises one cutout defined in the open top of the conical tube, whereby the at least one lug of the plug is engageable with the one cutout.

3. The decorative artificial icicle as claimed in claim 2, wherein the cutout is L-shaped.

4. The decorative icicle as claimed in claim 1, wherein the retaining device comprises two cutouts opposedly defined in the open top of the conical tube, and two of the at least one lug are respectively formed on the body, whereby the two lugs are respectively engageable with the two cutouts.

5. The decorative artificial icicle as claimed in claim 4, wherein the cutouts are L-shaped.

6. The decorative artificial icicle as claimed in claim 1, wherein the support means is a clip.

7. The decorative artificial icicle as claimed in claim 6, wherein the clip comprises at least one clamp adapted to grip the holder of at least one bulb.

8. The decorative artificial icicle as claimed in claim 6, wherein the clip comprises a plurality of clamps adapted to grip the holders of a respective plurality of bulbs.

9. The decorative artificial icicle as claimed in claim 1, wherein the slot radially extends from a circumference of the cap to a center of the cap and the electric wire extends from the interior space of the tube to an exterior through the slot when the lampset is fitted in the conical tube.

10. The decorative artificial icicle as claimed in claim 1, wherein the open top of the conical tube has a larger diameter than a diameter of the closed bottom of the conical tube.

* * * * *